US012172815B2

(12) United States Patent
Slovik et al.

(10) Patent No.: US 12,172,815 B2
(45) **Date of Patent: *Dec. 24, 2024**

(54) CONTAINER CARRIER

(71) Applicant: ILLINOIS TOOL WORKS INC., Glenview, IL (US)

(72) Inventors: Rachell L. Slovik, Bartlett, IL (US); Christopher J. Samaras, Tinley Park, IL (US); Robert C. Olsen, Medinah, IL (US); Michael P. Czarnecki, Jr., Bensenville, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/032,750

(22) PCT Filed: Oct. 20, 2021

(86) PCT No.: PCT/US2021/055820

§ 371 (c)(1),
(2) Date: Apr. 19, 2023

(87) PCT Pub. No.: WO2022/093593

PCT Pub. Date: May 5, 2022

(65) Prior Publication Data

US 2023/0382620 A1 Nov. 30, 2023

Related U.S. Application Data

(63) Continuation-in-part of application No. 17/504,624, filed on Oct. 19, 2021, now Pat. No. 11,623,804.
(Continued)

(51) Int. Cl.
*B65D 71/50* (2006.01)

(52) U.S. Cl.
CPC .... *B65D 71/504* (2013.01); *B65D 2571/0029* (2013.01); *B65D 2571/00456* (2013.01)

(58) Field of Classification Search
CPC ..... B65D 5/42; B65D 71/00; B65D 71/42; B65D 71/50; B65D 71/504; B65D 2571/0029; B65D 2571/00456
(Continued)

(56) References Cited

U.S. PATENT DOCUMENTS 2,936,070 A 5/1960 Poupitch
3,601,439 A 8/1971 Poupitch
(Continued)

FOREIGN PATENT DOCUMENTS

CA 1 029 691 A 4/1978
DE 10 2007 002 638 A1 1/2008

OTHER PUBLICATIONS

EPO, Rijswijk, NL, International Search Report, Form PCT/ISA/210 for International Application PCT/US2021/055820, Sep. 2, 2022 (2 pages).
(Continued)

*Primary Examiner* — Bryon P Gehman
(74) *Attorney, Agent, or Firm* — Pauley Erickson & Swanson

(57) ABSTRACT

A container carrier for unitizing a plurality of containers. The carrier includes a planar sheet of a material and a plurality of container receiving apertures within the planar sheet and arranged in longitudinal rows and transverse ranks. Each of the plurality of container receiving apertures includes a central opening shape and a plurality of clefts radially extending in the planar sheet outward from the central shape to form a plurality of container friction flaps each adapted to extend along a side wall of a corresponding container of the plurality of containers.

15 Claims, 2 Drawing Sheets

Related U.S. Application Data

(60) Provisional application No. 63/105,433, filed on Oct. 26, 2020.

(58) Field of Classification Search
USPC ..... 206/145, 147–151
See application file for complete search history.

(56) References Cited

U.S. PATENT DOCUMENTS

| | | | | |
|---|---|---|---|---|
| 5,415,278 | A | 5/1995 | Sutherland | |
| 6,874,620 | B2 | 4/2005 | Mattson et al. | |
| 7,377,382 | B2 * | 5/2008 | Borg | B65D 71/50 294/87.2 |
| 11,365,039 | B2 | 6/2022 | Berga Ferres | |
| 11,420,802 | B2 * | 8/2022 | Kooc | B65D 71/504 |
| 2004/0134799 | A1 | 7/2004 | Mattson et al. | |

OTHER PUBLICATIONS

EPO, Rijswijk, NL, Written Opinion of the International Searching Authority, Form PCT/ISA/237 for International Application PCT/US2021/055820, Sep. 2, 2022 (7 pages).

* cited by examiner

CONTAINER CARRIER

CROSS-REFERENCE TO RELATED APPLICATIONS

This application is a National Phase Application of PCT Patent Application No. PCT/US2021/055820, filed on 20 Oct. 2021, which claims priority to each of: U.S. Provisional Application, Ser. No. 63/105,433, filed 26 Oct. 2020; and U.S. patent application Ser. No. 17/504,624, filed on 19 Oct. 2021, now U.S. Pat. No. 11,623,804, which claims the benefit of U.S. Provisional Application, Ser. No. 63/105,433, filed 26 Oct. 2020. The parent patent applications are hereby incorporated by reference herein in its entirety and are made a part hereof, including but not limited to those portions which specifically appear hereinafter.

BACKGROUND OF THE INVENTION

Field of the Invention

This invention relates to a container carrier having container receiving apertures for unitizing a plurality of containers, and more particularly to a container carrier with improved surface contact with container sidewalls.

Description of Prior Art

Conventional container carriers are often used to unitize a plurality of similarly sized containers, such as cans, bottles, jars, and boxes and/or similar containers that require unitization. Flexible plastic ring carriers are one such conventional container carrier.

Flexible plastic ring carriers having a plurality of container receiving apertures, typically of an oval, round, or rectangular configuration, that each engage a corresponding container, may be used to unitize groups of four, six, eight, twelve or other suitable groups of containers into a convenient multipackage. Flexible ring carriers are known where the container apertures stretch around an upper flange area of a container, and that may contact an undersigned of a beaded chime edge at the intersection of the flange area and the container top.

SUMMARY OF THE INVENTION

The present invention is directed to a container carrier that improves the connection between, and holding of, the container apertures and the containers therein. Embodiments of this invention add material internal to the carrier aperture, such as via multiple flaps, to increase the surface contact with the sidewall of the container. The increased surface area allows for improved container retention with limited aperture elongation, less than standard carriers for similar retention characteristics.

The invention includes a container carrier for unitizing a plurality of containers, including a planar sheet of a plastic material and a plurality of container receiving apertures within the planar sheet and arranged in longitudinal rows and transverse ranks. Each of the plurality of container receiving apertures includes a central opening shape and a plurality of clefts extending in the planar sheet outward from the central shape to form a plurality of container friction flaps each adapted to extend along a side wall of a corresponding container of the plurality of containers.

In embodiments of this invention, the central opening shape has a diameter that is 80% or less than a diameter of a container portion to be inserted and secured. The distance between opposing pairs of the plurality of container friction flaps is desirably between 50% and 80% of a diameter of a container portion to be secured. Each of plurality of clefts includes an end opposite the central opening shape and a distance between ends of opposing pairs of clefts is between 90% and 120% of the diameter of the container portion to be secured.

In embodiments of this invention, the central opening shape is circular or oval, and an inner edge of each of the plurality of container friction flaps includes a curve to form a section of the central opening shape. The inner edge of each of the plurality of container friction flaps can include on opposing ends of the curve a rounded transitions into a corresponding one the plurality of clefts.

Each of the plurality of container friction flaps is generally between two of the plurality of clefts. Each of the plurality of clefts can include a rounded end radially opposite the central opening shape.

In embodiments of this invention, each container receiving aperture has only four clefts, each extending opposite and parallel from an other of the four clefts. Each of the clefts is desirably at one of four corners of the central opening shape. Each of the four clefts extends to a corner of an aperture profile configured to correspond to one of the containers. In some embodiments, a combined cleft length of opposing pairs of clefts is greater than a maximum diameter of the central opening shape measured between opposing container friction flaps.

In embodiments of this invention, a rectangularly shaped intermediate aperture is formed between each pair of container receiving apertures, the intermediate aperture including rounded corners and two concave sides pinched inwardly toward a center of the intermediate aperture. Pairs of such apertures can form a handle for carrying.

In embodiments of this invention, a registration aperture is provided, corresponding to each traverse rank of the container receiving apertures. The registration aperture can be between the container receiving apertures and an outer edge of the container carrier, such as for use in application of the carrier to containers. In some embodiments, a plurality of registration apertures is aligned along each longitudinal row of the container carrier adjacent to, and outside of, an array of container receiving apertures.

Embodiments of this invention further include a container carrier including a planar sheet of a plastic material and a plurality of container receiving each including an aperture profile corresponding to a container portion to be inserted and secured. A central opening shape is included within the aperture profile, and a plurality of clefts extend in the planar sheet outward from the central opening shape to the aperture profile. Container friction flaps extend from the aperture profile to the central opening shape between adjacent pairs of the plurality of clefts.

The aperture profile can have rounded sides, such as a superellipse. Again, the central opening shape desirably has a diameter that is 80% or less than a diameter of a container portion to be inserted and secured, and each of plurality of clefts includes an end opposite the central opening shape and a distance between ends of opposing pairs of clefts is between 90% and 120% of the diameter of the container portion to be secured.

The invention further includes a package of a plurality of containers. The package includes a plurality of can containers, each including a main body wall, a top end lid, an angled shoulder extending between the main body wall and the top end lid, and a chime at an intersection of the angled shoulder and the top end wall. The package further includes a planar sheet of a plastic material having a plurality of container receiving apertures arranged in longitudinal rows and transverse ranks. Each of the plurality of container receiving apertures includes a central opening shape and a plurality of clefts extending in the planar sheet outward from the central shape to form a plurality of container friction flaps. Each of the plurality of can containers is positioned within a corresponding one of the plurality of container receiving apertures such that each of the container friction flaps is secured against the main body wall of a corresponding can container.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
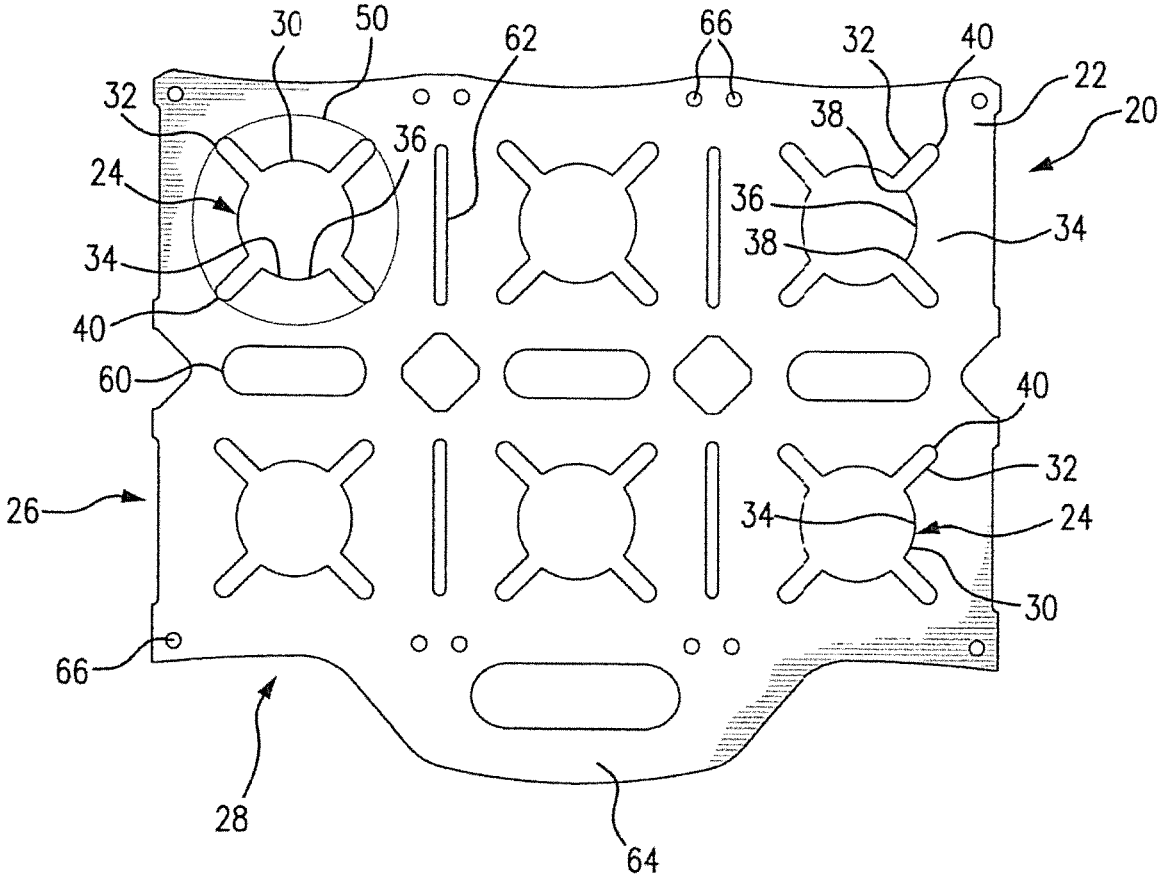
FIG. 1 shows a container carrier, according to an embodiment of this invention.

FIG. 1 shows an exemplary container carrier 20 for unitizing a plurality of containers, according to one embodiment of this invention. The carrier 20 is formed of a planar sheet 22 of a plastic or equivalent material. The carrier includes a plurality of container receiving apertures 24 within the planar sheet 22. The container receiving apertures 24 are arranged in longitudinal rows 26 (e.g., two shown) and transverse ranks 28 (e.g., three shown). Each of the container receiving apertures 24 is adapted to secure a corresponding container (See FIG. 2).

Each of the container receiving apertures 24 including a central opening shape and a plurality of clefts 32 cut and extending in the planar sheet 22 radially outward from the central shape 30 to form a plurality of container friction flaps 34 in/from the planar sheet 22. Each of the plurality of container friction flaps 34 is between two of the plurality of clefts 32. As illustrated, the central opening shape 30 is circular, and an inner edge 36 of each of the plurality of container friction flaps 34 includes a curve to form a section of the central opening shape 30. The central opening shape can be other shapes depending on need and/or the container, such as oval, or square or other polygon with corresponding straight inner flap edges as needed, and generally the central opening shape is a regular shape, having clefts extending, for example, at four corners of the shape. In the embodiment of FIG. 1, the inner edge 36 of each of the plurality of container friction flaps 34 includes on opposing ends of the curve a rounded transition 38 into a corresponding one the plurality of clefts.

Each of the plurality of container friction flaps 34 is between two of the plurality of clefts 32. Each cleft 32 also has an opposing, desirably matching or identical, cleft 32 on an opposite side of the central shape 30, parallel and aligned on the same axis. Each of the clefts 32 includes a rounded end 40 opposite the central opening shape 30. The number and angle of the clefts about the central shape 30 can vary depending on need, and the size and shape of the container to be secured. The embodiment of FIG. 1 includes four clefts 32 spaced equidistant (each extending radially at 90 degrees) about the central shape 30, such as providing four equally sized friction flaps 34, and for holding a circular can (See FIG. 2). As another example, FIG. 3 illustrates a planar sheet 222 with container receiving apertures 224 having an oval (e.g., an ellipse) central opening shape 230 with four clefts 232 forming two different sizes of friction flaps 234, with opposing friction flaps desirably having matching or identical sizes and/or shapes. The angle $\alpha$ between a first pair of adjacent clefts 232 forming wider and shorter friction flaps 234' is greater than 90 degrees, and the angle $\beta$ between a second pair of adjacent clefts 232, forming narrower and taller friction flaps 234", is less than 90 degrees. The container receiving apertures 224 can also secure a cylindrical can or other shaped container, and provides container receiving apertures 224 and/or friction flaps 234 of varying stretch and/or securing force.

Figure 2:
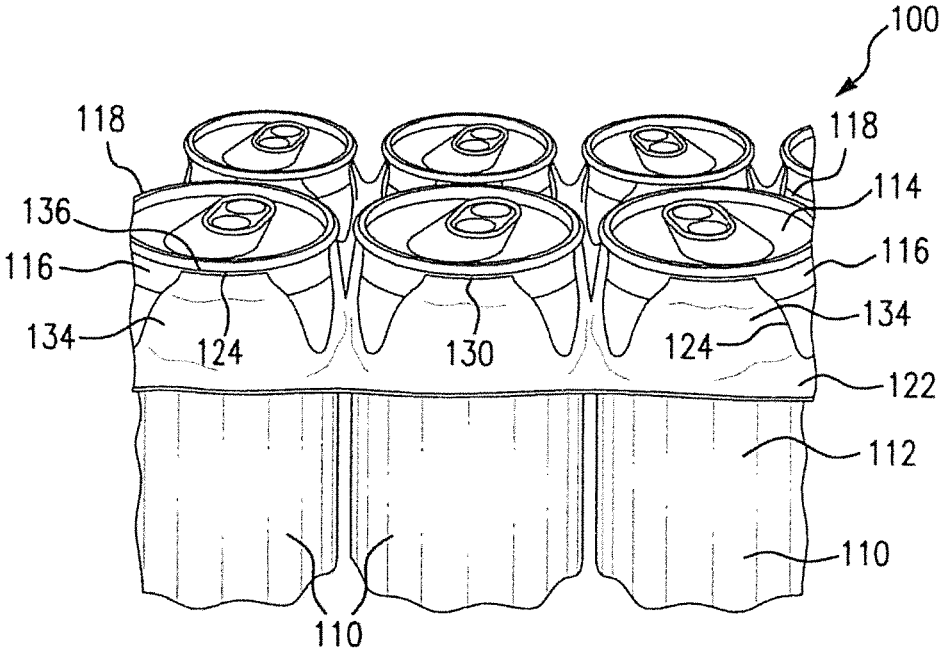
FIG. 2 shows a package of containers, according to an embodiment of this invention.
Figure 3:
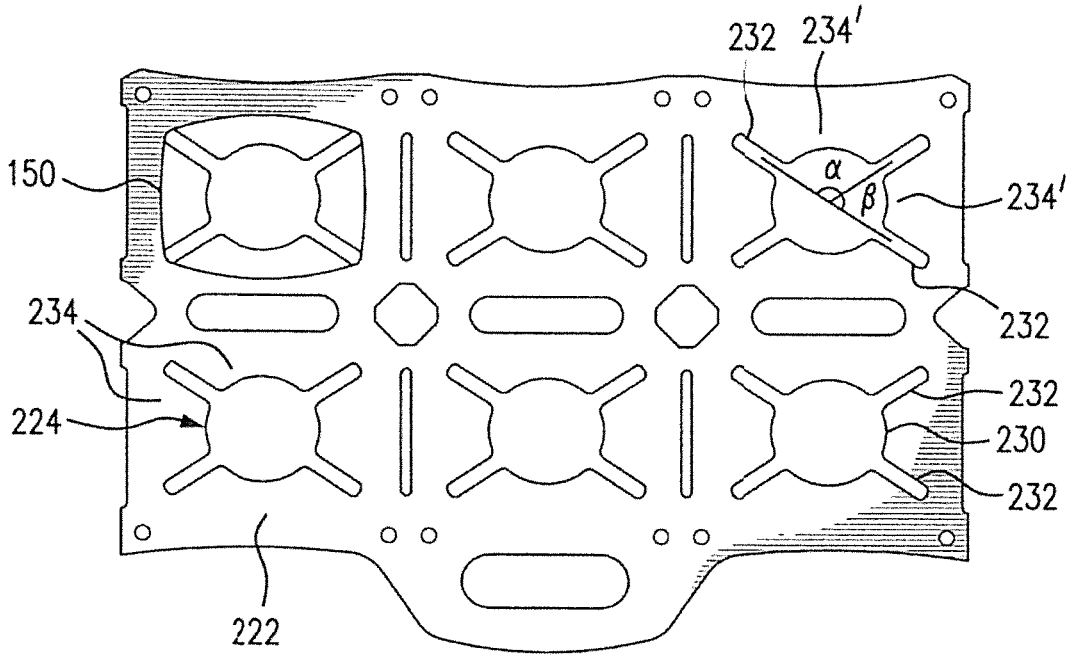
FIG. 3 shows a container carrier, according to an embodiment of this invention.

FIG. 2 shows a package 100 of a plurality of containers 110. Each of the containers 110, shown as cylindrical can containers (e.g., soda or equivalent), include a cylindrical main body side wall 112, a top end lid wall 114, an angled shoulder 116 extending between the main body side wall 112 and the top end lid 114, and a chime 118 formed at an intersection of the angled shoulder 116 and the top end lid wall 114.

The package 100 further includes a planar sheet 122 having a plurality of container receiving apertures 124 each receiving and secured around one of the containers 110. For each aperture 124, the inner edge 136 of the central opening shape 130 desirably at least partially abuts an underside of the corresponding chime 118. The friction flaps 134 extend from the chime 118 over the angled shoulder 116 and down a portion of the main body side wall 112. The increased surface area of the friction flaps of this invention allows for improved container retention with limited aperture elongation.

The size, shape, and configuration of the container receiving apertures, namely each of the central opening shape, the clefts, and the friction flaps can vary depending on need and the container to be secured. In embodiments of this invention, the central opening shape (i.e., the circle diameter) has a maximum diameter, measured between inner edges of the friction flaps that is about 85% or less of a diameter of a container portion to be inserted and secured, more desirably less than about 80%, and preferably less than about 75%, and more preferably less that about 70%. In embodiments of this invention, the maximum diameter of the central opening shape is greater than about 40% of a diameter of a container portion to be inserted and secure, more desirably greater than about 50%. In particular embodiments, the maximum diameter is between about 50% and about 85%, or any percentage there between, such as more desirably between about 50% and about 80%, and preferably between about 60% and about 80%.

Each of plurality of clefts includes an end open to the central opening shape and a radially outward end opposite the central opening shape. A distance between opposing outward ends of opposing pairs (parallel and colinear along the same axis) of clefts is between about 90% and about 120% of the diameter of the container portion to be secured, or any percentage therein, such as more desirably between about 90% and about 110%, and preferably about 95% to about 105%. In embodiments of this invention, a combined cleft length of opposing pairs of clefts is equal or greater than a maximum diameter of the central opening shape measured between opposing container friction flaps. As shown in FIGS. 1 and 3, the four ends of the clefts end at corners of an aperture profile 50 and 150 corresponding to a container portion to be inserted and secured. The aperture profile represents a traditional aperture periphery needed to secure the container about the side wall, such as without the friction flaps. The aperture profile can be imaginary, for determining cleft and flap size, or real, such as by modifying the planar sheet with more or less material thickness within the aperture profile, or otherwise providing a line of weakness. The aperture profile 50, 150 has four rounded sides meeting at the corners at the clefts. In this manner, the aperture profile is a superellipse, such as a rounded rectangle or square (e.g., a squircle).

A preferred carrier configuration includes bands forming two distinct parallel rows of container receiving apertures. Each rank preferably includes two container receiving apertures (one for each row in the carrier). Preferably, each of the carriers shown is manufactured in a generally continuous string of carriers wherein the carriers are punched or otherwise formed longitudinally adjacent to other carriers. In this manner, the continuous string of carriers is formed that may be rolled onto reels or folded into boxes for later unwinding and application to containers. The carriers are then cut into individual carriers and formed into individual multipackages.

Referring again to FIG. 1, according to one preferred embodiment, an oval (e.g., a stadium shape) aperture 60 is positioned between each container receiving aperture 24 in transverse ranks 28. Each transverse oval aperture 60 is preferably positioned midway between each adjacent container receiving aperture 24 of the rank. Similarly, a second oval aperture 62, is preferably positioned midway between each adjacent container receiving aperture 24 of the rows 26. According to a preferred embodiment, a major axis of the transverse oval apertures 60 is preferably perpendicular to a major axis of additional longitudinal oval apertures 62. As shown in FIG. 1, the oval apertures 62 are preferably narrower than the oval apertures 60.

Carriers can include a handle 64 that extends upwardly from the carrier to enable a consumer to carry the package from the top (called a "top lift carrier") or outwardly as shown from a side of the carrier to enable a consumer to carry the package from the side (called a "side lift carrier"). Container carriers may also contain holes in a center void area among the container receiving apertures which may also be used to carry the package. Additionally, features such as tear tabs and perforations may be included in the carrier 20 to ease removal of the containers from the container carrier 20.

As shown, the container carrier 20 can include a plurality of registration apertures 66 positioned longitudinally along the container carrier 20. As shown in FIG. 1, the plurality of registration apertures 66 may be positioned along outer perimeters of the container carrier 20. Alternatively, the plurality of registration apertures 66 may also be positioned in other longitudinal rows such as down the center of the transverse ranks. It is to be understood that the plurality of registration apertures 66 are not limited to their positions disclosed in the figures, and that any number of registration apertures 66 may be present at any number of locations on the container carrier 20.

Figure 4:
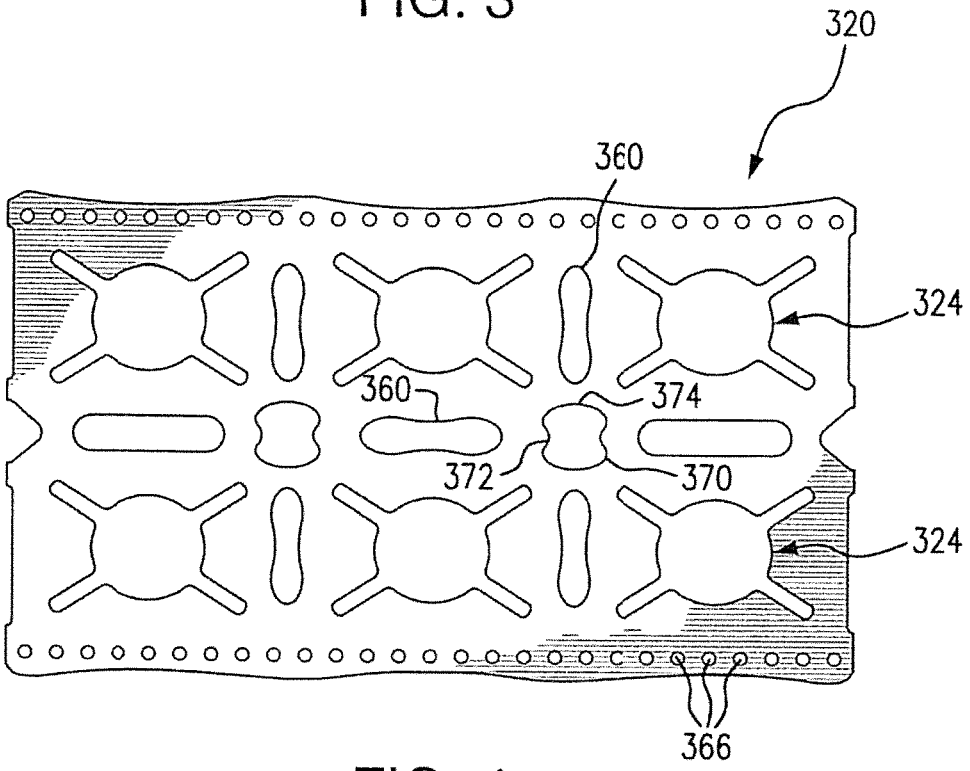
FIG. 4 shows a container carrier, according to an embodiment of this invention.

FIG. 4 shows alternative features in carrier 320 that can be incorporated individually or in any combination with any illustrated embodiment. Carrier 320 includes a bone-shaped apertures 360 with two concave sides 370 is positioned between container receiving apertures 324. The bone-shaped apertures 360 can replace some or all of the oval apertures 60 and/or 62 of FIG. 1. The carrier 320 also includes an intermediate aperture 370 formed in a primarily rectangular shape with two complimentary concave sides 372 opposite one another, and two straight sides 374. As described, the intermediate aperture 370 is defined as an aperture positioned between both each transverse rank and each longitudinal row of container receiving apertures 324. The intermediate aperture 370 provides additional surface area and ease of use as a handle as compared to previous intermediate apertures that were formed in a diamond shape (See FIG. 1). FIG. 4 also includes a continuous strip of registration apertures 366 positioned longitudinally along outer side edges of the container carrier 320, outside of the array of container receiving apertures 324.

While in the foregoing specification this invention has been described in relation to certain preferred embodiments thereof, and many details have been set forth for purpose of illustration, it will be apparent to those skilled in the art that the subject invention is susceptible to additional embodiments and that certain of the details described herein can be varied considerably without departing from the basic principles of the invention.

The invention claimed is:

1. A container carrier for unitizing a plurality of containers comprising:

a planar sheet of a material;

a plurality of container receiving apertures within the planar sheet and arranged in longitudinal rows and transverse ranks, each of the plurality of container receiving apertures including a central opening shape and a plurality of clefts extending in the planar sheet outward from the central shape to form a plurality of container friction flaps each adapted to extend along a side wall of a corresponding container of the plurality of containers, wherein each of the plurality of clefts extends opposite and parallel from an other of the plurality of clefts, each of the plurality of container friction flaps is between two of the plurality of clefts, and a combined cleft length of opposing pairs of clefts is greater than a maximum diameter of the central opening shape measured between opposing container friction flaps.

2. The container carrier according to claim 1, wherein the central opening shape has a diameter that is 80% or less than a diameter of a container portion to be inserted and secured within the each of the plurality of container receiving apertures.

3. The container carrier according to claim 1, wherein a distance between opposing pairs of the plurality of container friction flaps is between 50% and 80% of a diameter of a container portion to be secured.

4. The container carrier according to claim 3, wherein each of plurality of clefts includes an end opposite the central opening shape and a distance between ends of opposing pairs of clefts is between 90% and 120% of the diameter of the container portion to be secured.

5. The container carrier according to claim 1, wherein the central opening shape is circular or oval, and an inner edge of each of the plurality of container friction flaps includes a curve to form a section of the central opening shape.

6. The container carrier according to claim 5, wherein each opposing end of the inner edge of each of the plurality of container friction flaps comprises a rounded transition into a corresponding one the plurality of clefts.

7. The container carrier according to claim 1, wherein each of the plurality of clefts includes a rounded end radially opposite the central opening shape.

8. The container carrier according to claim 1, having only four clefts, wherein each of the four clefts extends to a corner of an aperture profile configured to correspond to one of the containers.

9. The container carrier according to claim 1, further comprising:

a rectangularly shaped intermediate aperture formed between each pair of container receiving apertures, the intermediate aperture including rounded corners and two concave sides pinched inwardly toward a center of the intermediate aperture; and a registration aperture corresponding to each traverse rank of the container receiving apertures, the registration aperture between the container receiving apertures and an outer edge of the container carrier.

10. A container carrier for unitizing a plurality of containers comprising:

a planar sheet of a material;

a plurality of container receiving apertures within the planar sheet and arranged in longitudinal rows and transverse ranks, each of the plurality of container receiving apertures including a central opening shape and a plurality of clefts extending in the planar sheet outward from the central shape to form a plurality of container friction flaps each adapted to extend along a side wall of a corresponding container of the plurality of containers;

wherein each of the plurality of container receiving apertures has only four clefts each extending opposite and parallel from an other of the four clefts, and forming only four container friction flaps;

wherein the material within an aperture profile of the each of the plurality of container receiving apertures has more or less material thickness than the sheet of the planar sheet outside of the aperture profile; and wherein the central opening shape has a diameter that is 80% or less than a diameter of a container portion to be inserted and secured within the each of the plurality of container receiving apertures.

11. The container carrier according to claim 10, wherein the aperture profile has rounded sides.

12. The container carrier according to claim 10, wherein the central opening shape is an oval or ellipse.

13. The container carrier according to claim 10, wherein the aperture profile is a superellipse.

14. The container carrier according to claim 10, having two different sizes of friction flaps, with opposing pairs of friction flaps having matching or identical sizes and shapes.

15. The container carrier according to claim 10, wherein each of plurality of clefts includes an end opposite the central opening shape and a distance between ends of opposing pairs of clefts is between 90% and 120% of the diameter of the container portion to be secured.

* * * * *